US007126597B2

(12) United States Patent
Shino et al.

(10) Patent No.: US 7,126,597 B2
(45) Date of Patent: Oct. 24, 2006

(54) SCANNING CIRCUIT AND IMAGE DISPLAY DEVICE

(75) Inventors: Kenji Shino, Kanagawa (JP); Tadashi Aoki, Kanagawa (JP); Aoji Isono, Kanagawa (JP); Kazuhiko Murayama, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/207,222

(22) Filed: Jul. 30, 2002

(65) Prior Publication Data

US 2003/0025687 A1 Feb. 6, 2003

(30) Foreign Application Priority Data

Jul. 31, 2001 (JP) ..... 2001-232593
Jul. 17, 2002 (JP) ..... 2002-207966

(51) Int. Cl.
*G09G 5/00* (2006.01)

(52) U.S. Cl. ..... 345/212; 345/60; 345/82; 345/100

(58) Field of Classification Search ..... 345/42, 345/50, 51, 55, 58, 82, 87, 90, 93, 98, 100, 345/103, 104, 212–214, 60, 63; 315/169.1, 315/169.3, 169.4; 313/500
See application file for complete search history.

(56) References Cited

U.S. PATENT DOCUMENTS 4,904,895 A 2/1990 Tsukamoto et al. ..... 313/336
5,066,883 A 11/1991 Yoshioka et al. ..... 313/309
5,434,599 A 7/1995 Hirai et al. ..... 345/100
5,442,370 A * 8/1995 Yamazaki et al. ..... 345/94
5,477,110 A 12/1995 Smith et al. ..... 315/169.3
5,489,910 A 2/1996 Kuwata et al. ..... 345/212
5,569,974 A 10/1996 Morikawa et al. ..... 313/310
5,593,335 A 1/1997 Suzuki et al. ..... 445/50
5,594,463 A * 1/1997 Sakamoto ..... 345/76
5,619,221 A 4/1997 Hirai et al. ..... 345/58
5,646,643 A 7/1997 Hirai et al. ..... 345/100
5,654,607 A 8/1997 Yamaguchi et al. ..... 313/495

(Continued)

FOREIGN PATENT DOCUMENTS

CN 1195785 10/1998

(Continued)

OTHER PUBLICATIONS

W.P. Dyke, et al., *Field Emission*, Advances in Electronics and Electron Physics, vol. 8, Academic Press Inc. (1956) pp. 89-185.

(Continued)

*Primary Examiner*—Henry N. Tran
(74) *Attorney, Agent, or Firm*—Fitzpatrick, Cella, Harper & Scinto

(57) ABSTRACT

A scanning circuit and an image display device in which the influence of losses in a signal path to scanning wiring and a scanning signal output circuit can be reduced. By considering matrix drive in which one row is driven at a time and two or more of the rows are not simultaneously driven, the 480 rows are divided into six modules and one feedback circuit is provided in correspondence with each module to perform feedback control of the output buffers corresponding to 80 rows. An output from a switch is amplified by an operational amplifier and is input as a compensation signal to all the output buffers by an output voltage compensation circuit. Compensation for a voltage drop is made by using the compensation signal for an increase in voltage such that the apparent voltage drop due to the output current is limited to a small value.

15 Claims, 12 Drawing Sheets

U.S. PATENT DOCUMENTS

| | | | | |
|---|---|---|---|---|
| 5,682,085 | A | 10/1997 | Suzuki et al. | 315/169.1 |
| 5,734,361 | A * | 3/1998 | Suzuki et al. | 345/74.1 |
| 6,195,076 | B1 | 2/2001 | Sakuragi et al. | 345/74 |
| 6,294,876 | B1 | 9/2001 | Ando et al. | 315/169.1 |
| 6,400,348 | B1 * | 6/2002 | Young | 345/78 |
| 6,404,135 | B1 | 6/2002 | Shino | 315/169.1 |
| 6,489,940 | B1 | 12/2002 | Aoki | 345/93 |
| 6,703,792 | B1 * | 3/2004 | Kawada et al. | 315/169.4 |
| 2001/0013758 | A1 * | 8/2001 | Tsuruoka et al. | 315/169.3 |
| 2002/0195966 | A1 | 12/2002 | Aoki et al. | 315/169.3 |
| 2003/0038792 | A1 | 2/2003 | Murayama et al. | 345/204 |
| 2003/0063108 | A1 | 4/2003 | Isono et al. | 345/690 |
| 2003/0076049 | A1 * | 4/2003 | Kawada et al. | 315/169.4 |
| 2004/0001039 | A1 | 1/2004 | Shino et al. | 345/100 |

FOREIGN PATENT DOCUMENTS

| | | |
|---|---|---|
| EP | 0858 065 A1 | 8/1998 |
| JP | 64-31332 | 2/1989 |
| JP | 2-257551 | 10/1990 |
| JP | 3-55738 | 3/1991 |
| JP | 4-28137 | 1/1992 |
| JP | 5-188349 | 7/1993 |
| JP | 5-212905 | 8/1993 |
| JP | 6-180564 | 6/1994 |
| JP | 6-230338 | 8/1994 |
| JP | 7-181917 | 7/1995 |
| JP | 7-281151 | 10/1995 |
| JP | 8-22261 | 1/1996 |
| JP | 9-281928 | 10/1997 |
| JP | 9-319327 | 12/1997 |
| JP | 10-39825 | 2/1998 |
| JP | 10-112391 | 4/1998 |
| JP | 10-153759 | 6/1998 |
| JP | 11-15430 | 1/1999 |
| JP | 3049061 | 3/2000 |

OTHER PUBLICATIONS

C.A. Spindt et al., *Physical Properties of Thin-film Field Emission Cathodes with Molybdenum Cones*, J. Appl. Phys., vol. 47, No. 12 (1976) pp. 5248-5258.

C.A. Mead, *Operation of Tunnel-Emission Devices*, Journal of Applied Physics, vol. 32, No. 4, (1961) pp. 646-652.

M.I. Elinson et al., "The Emission Of Hot Electrons And The Field Emission Of Electrons From Tin Oxide," Radio Engineering and Electronic Physics, pp. 1290-1296, No. 8, Aug. 1965.

G. Dittmer, *Electrical Conduction and Electron Emission of Discontinuous Thin Films*, Thin Solid Films, vol. 9, (1972) pp. 317-328.

M. Hartwell et al., *Strong Electron Emission From Patterned Tin-Indium Oxide Thin Films*, Internataional Electron Devices Meeting (1975) pp. 519-521.

Araki et al., *Electroforming and Electron Emission of Carbon Thin Films*, Electron Beam Laboratory, Faculty of Engineering, Osaka University (1981) pp. 22-29 (English Abstract on p. 22).

Office Action (in Japanese) from counterpart application 2002-207966 from Patent Office in Japan, dated Sep. 6, 2004.

Office Action (in Chinese) counterpart application 021274096 from Patent Office in China, dated Aug. 11, 2004.

Office Action in Korean from counterpart application 519980959073 from Patent Office in Korea, dated Jul. 25, 2005.

* cited by examiner

SCANNING CIRCUIT AND IMAGE DISPLAY DEVICE

BACKGROUND OF THE INVENTION

1. Field of the Invention

The present invention relates to an image display device and to a scanning circuit used in the image display device.

2. Description of the Related Art

There has been a voltage drop problem in some cases of drive of a semiconductor circuit with a low-resistance load due to the on resistance (Ron) of an output portion (output buffer) of the semiconductor circuit.

As a method of reducing the resistance of an output portion of a semiconductor circuit, the method of increasing the semiconductor chip area is known. For example, in the case of increasing the chip area of a MOS device having a high withstand voltage, it is necessary for the MOS device to have a double diffusion structure. In such a case, the area occupied by the chip is increased. That is, an area of about 1 $mm^2$ is occupied in the case of obtaining an output on resistance (Ron) of 100 mΩ.

If a semiconductor integrated circuit having an 80-channel output portion is designed, an area of 80 $mm^2$ is occupied by the output buffer alone. Further, a prebuffer is required for drive of the output buffer. In actuality, therefore, a chip area close to 100 $mm^2$ is required for the output buffer alone.

Arts described below are known which relate to the invention of the present application.

JP-A 6-230338 A discloses an arrangement in which feedback control is performed to apply a bias voltage with stability to semiconductor devices for driving a liquid crystal display device.

JP-A 10-153759 A discloses a correction circuit in which dummy wiring is provided in parallel with scanning lines in a liquid crystal panel, a signal line drive current flowing through the dummy wiring is converted into a distortion voltage, and the difference between the distortion voltage and a reference voltage is fed back to a scanning line drive circuit to correct a distortion of the signal line drive voltage.

JP-A 5-212905 A discloses a device for forming an image with a printing head using an LED array and discloses, in particular, an arrangement in which a voltage detection resistor is connected in parallel with an LED array drive transistor to detect an abnormality of the printing head.

SUMMARY OF THE INVENTION

In designing a semiconductor circuit in which the resistance of an output portion is reduced, it is necessary to increase the chip area, as mentioned above. If the chip area is increased, a problem arises that the number of chips obtained from one wafer is reduced whereby the unit price per chip is increased. The influence of the increase in chip area is particularly large in the case of an multiple-output IC.

Also, the resistance of bonding wires is not negligible. For example, in the case of a gold wire having a diameter of 30 μm, the resistance per millimeter is about 45 mΩ. If the length of a bonding wire formed of this gold wire between a bonding pad and IC lead is 2 mm, a voltage drop of 90 mΩ×1 A=0.09 V occurs when the output is 1 A, and a voltage drop of 90 mΩ×5 A=0.45 V occurs when the output is 5 A.

To avoid the influence of the resistance of the bonding wire, the method of using a pair of the bonding wire may be used. However, the influence cannot be completely eliminated by this method.

As described above, there has been a problem that the influence of the resistance of the bonding wire appears in the output when the output current is large.

The present invention has been made in view of the above, and an object of the present invention is therefore to realize a scanning circuit and an image display device in which the influence of losses in a signal path to scanning wiring and a scanning signal output circuit can be reduced.

In order to attain the above-mentioned object, according to the present invention, there is provided a scanning circuit which is used in a display device having a plurality of scanning wiring lines and a plurality of modulation wiring lines, and which sequentially applies a scanning signal to the scanning wiring lines, the scanning signal being applied to part of the scanning wiring lines at a time, the scanning circuit being characterized by comprising: an output circuit which outputs the scanning signal; and conductors forming paths for the scanning signal between the output circuit and the scanning wiring lines, the output circuit outputting the scanning signal on the basis of a compensation signal for compensation for a loss in the scanning signal in: at least a portion of the output circuit, at least a portion of the conductors, or at least a portion of the output circuit and at least a portion of the conductors.

As the compensation signal for compensation for the loss, a compensation signal for predicting the loss and for compensating for the predicted loss may be used. More specifically, a feedback control arrangement may be adopted in which feedback control is performed by detecting the loss and by making compensation with respect to the resulting output on the basis of the result of the detection.

At least part of the conductor may be a semiconductor.

The scanning circuit according to the present invention further comprises a compensation signal output circuit which outputs the compensation signal according to the signal level at one of the conductors to which the scanning signal is output.

The signal level at the conductor is, for example, a potential at the conductor or a current flowing through the conductor.

The compensation signal output circuit may include a feedback circuit constituted by an analog operational amplifier.

The compensation signal output circuit may include first conversion means for converting an analog signal input to the compensation signal output circuit into a digital signal, digital computation means for obtaining the compensation signal from the digital signal converted by the first conversion means by performing computational processing and for outputting the compensation signal, and second conversion means for converting the digital compensation signal output from the digital computation means into an analog signal and for outputting the analog compensation signal.

An A/D converter can be suitably used as the first conversion means, and a D/A converter can be suitably used as the second conversion means. Further, a hardware logic circuit or software operational processing using a microcomputer can be suitably used as the digital computation means.

The conductors may be provided in correspondence with the plurality of scanning wiring lines, and the compensation signal output circuit outputs the compensation signal according to the signal level at one of the plurality of conductors to which the scanning signal is output.

The scanning circuit according to the present invention further comprises a selecting circuit which outputs a selection signal for selecting one of the scanning wiring lines to which the scanning signal should be applied, in which the output circuits are provided in correspondence with the scanning wiring lines, and the output circuit outputs the scanning signal on the basis of the compensation signal and the selection signal.

A shift register can be suitably used as the selecting circuit.

It is desirable that a non-selecting potential be applied to the scanning wiring lines not designated by the selecting circuit to be selected. An arrangement in which the output circuit also functions as a circuit for applying the non-selecting potential to the unselected scanning wiring lines can be preferably adopted.

The scanning circuit according to the present invention is characterized in that at least a portion of a circuit constituting the scanning circuit is integrated to form a semiconductor integrated circuit.

For example, the semiconductor circuit thus arranged is formed by a CMOS process or a bipolar process.

The scanning circuit according to the present invention is characterized in that at least a portion of a circuit constituting the scanning circuit and including the output circuit is integrated to form a semiconductor integrated circuit, and the loss in the scanning signal includes a voltage drop due to the on resistance of a driver in the output circuit.

The above-mentioned loss also includes a voltage drop due to the resistance of wiring for supplying the scanning signal form the output circuit to a bonding pad, a voltage drop due to the electrical resistance of a bonding wire electrically connected to the bonding pad, and a voltage drop due to the resistance of external wiring electrically connected to the semiconductor integrated circuit main unit.

According to the present invention, there is also provided an image display device characterized by comprising: a plurality of scanning wiring lines; a plurality of modulation wiring lines; one of the above-described scanning circuits; and a modulation circuit which applies a plurality of modulation signals to the plurality of modulation wiring lines corresponding to the plurality of scanning wiring lines to which the scanning signal is applied, the modulation signals being applied while the scanning signal being applied.

The image display device according to the present invention further comprises display elements driven by the scanning signal applied through the scanning wiring lines, and the modulation signals applied through the modulation wiring lines.

As the display element, an electron emitting device used in combination with a luminescent member capable of producing light when irradiated with electrons, an electroluminecent element, or a cell constituting a plasma display can be suitably used.

DESCRIPTION OF THE PREFERRED EMBODIMENTS

Preferred embodiments of the present invention will be described below in detail with reference to the accompanying drawings by way of examples. In the following description of embodiments of the present invention, a mention of the size, material, shape, relative position, etc., of the components in the embodiments other than descriptions for specifying the invention is not intended to limit the scope of the present invention.

(First Embodiment)

A semiconductor integrated circuit (IC) and an image display device having the semiconductor integrated circuit which represent a first embodiment of the present invention will be described with reference to FIGS. 1 to 6.

This embodiment will be described with respect to an example of use of the semiconductor integrated circuit having a compensation signal output circuit provided as a cold cathode display driver in the IC.

Figure 1:
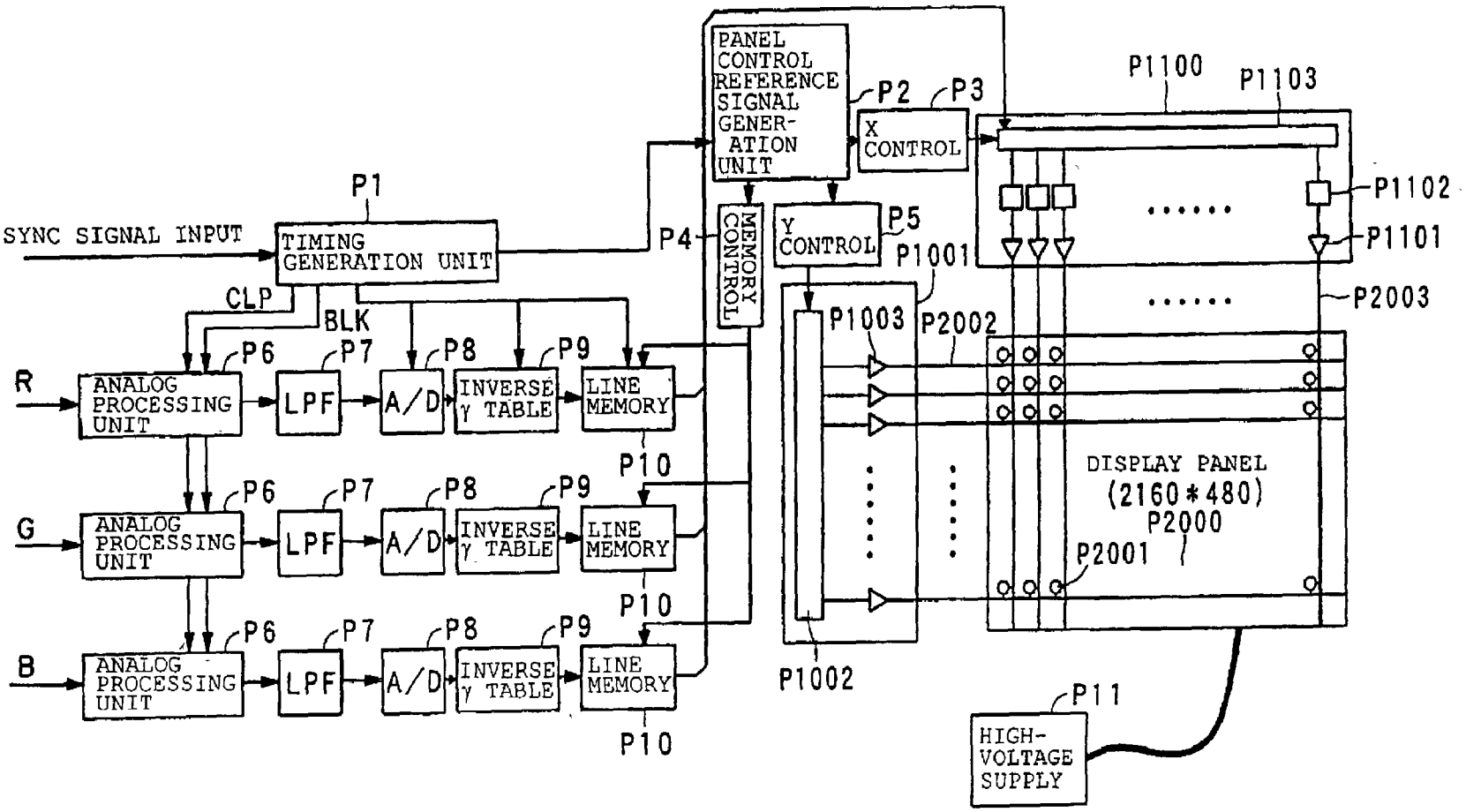
FIG. 1 is a block diagram of a drive circuit of an image display device which generally represents embodiments of the present invention.
Figure 2:
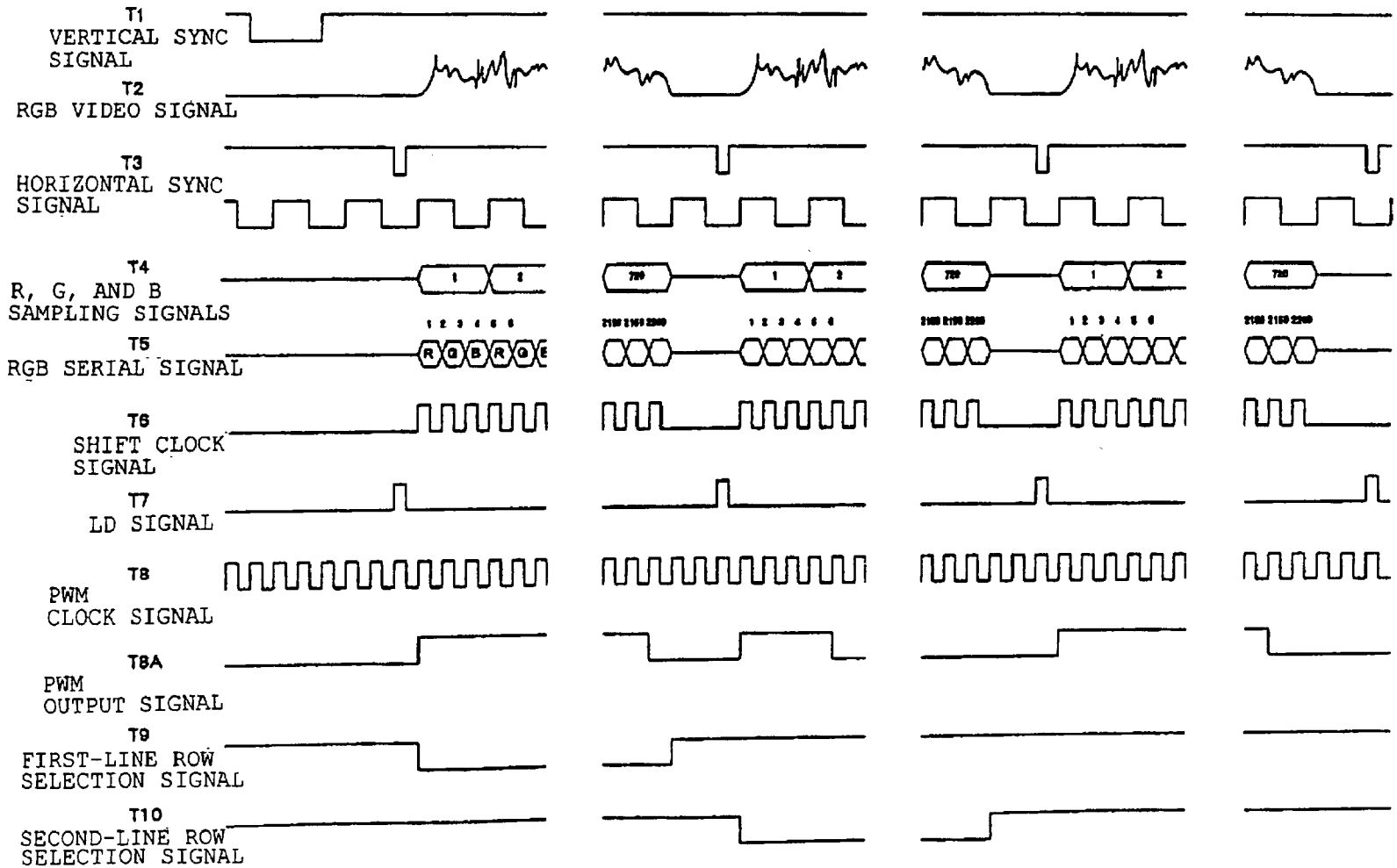
FIG. 2 is a diagram showing drive waveforms in the image display device which generally represents the embodiments of the present invention.

The image display device in which the semiconductor integrated circuit of this embodiment of the present invention is used will be described with reference to FIGS. 1 and 2. FIG. 1 is a block diagram of a drive circuit of the image display device (cold cathode display panel) representing the embodiment of the present invention. FIG. 2 is a diagram showing drive waveforms in the image display device representing the embodiment of the present invention.

A display panel P2000 is a display panel of a cold cathode display. In this embodiment, 480×2160 cold cathode elements P2001 are connected in a matrix by 480-row wiring lines P2002 arranged in a vertical direction and 2160-column wiring lines P2003 arranged in a horizontal direction.

Each cold cathode element P2001 emits electrons when a voltage of over ten volts is applied to it. Therefore the potential of a scanning signal applied to the row wiring lines (scanning wiring lines) is controlled so that the potential difference between the scanning signal applied to one of the row wiring lines to be selected and that of a modulated signal applied to the column wiring lines (modulation wiring lines) is over ten volts (a value exceeding an electron emission threshold voltage) while the potential difference between the potential at the scanning wiring lines which are not selected and that of the modulated signal is lower than the threshold value, thus enabling selection of the cold cathode elements P2001 in any one of the rows for emission of electrons.

Electrons emitted from each cold cathode element P2001 are accelerated by an anode electrode to which a high voltage is applied from a high-voltage supply P11 and irradiates a phosphor (not shown) to produce light.

This embodiment is an example of application in which an NTSC television image is displayed on the display panel having rows of 2160 pixels (RGB trio) extending in the horizontal direction and columns of 480 pixels extending in the vertical direction. However, the display panel of this embodiment can be adapted to display of any of high-resolution images other than the NTSC image, e.g., a high-definition television (HDTV) image and an extended graphics array (XGA) image, and computer output images. Thus, signals of images varying in resolution and in frame rate can be processed in substantially the same manner.

A timing generation unit P1 is supplied with an external sync signal or a sync signal from a sync separation circuit (sync separator) (not shown), and outputs a clamp pulse (CLP) and a blanking pulse (BLK) required for analog processing units P6.

The timing generation unit P1 also outputs a clock signal required for analog-to-digital (A/D) converters P8, inverse γ tables P9, and line memories P10 by using its internal phase-locked loop (hereafter referred to as "PLL"). This clock is synchronized with a horizontal sync signal T3 described below. Further, the timing generation unit P1 outputs the horizontal sync signal T3 and a vertical sync signal T1 shown in FIG. 2. Each of the horizontal sync signal T3 and the vertical sync signal T1 is used as a reference for a panel control reference signal generation unit P2.

The panel control reference signal generation unit P2 is a reference signal generation unit for controlling panel peripheral circuits. The panel control reference signal generation unit P2 outputs horizontal and vertical sync control signals to a X control P3, a memory control P4 and a Y control P5. Further, the panel control reference signal generation unit P2 incorporates a PLL and outputs a clock signal in synchronization with the horizontal sync signal.

The X control P3 outputs a shift clock T6, a load (LD) signal T7, and a pulse-width modulation (PWM) clock signal T8 each shown in FIG. 2 on the basis of the signal from the panel control reference signal generation unit P2. The shift clock T6, the LD signal T7 and the PWM clock signal TB are required for an X drive module P1100, which is a modulation circuit.

The memory control P4 is a control unit which outputs control signals for controlling reading timing of the line memories P10. The memory control P4 outputs a memory read clock (not shown) and a read address control signal (not shown) on the basis of the signal from the panel control reference signal generation unit P2.

The Y control P5 outputs a Y shift clock (not shown) required for a Y drive module P1001, which is a scanning circuit.

The analog processing units P6 amplify analog RGB video signal inputs to a level for input to the A/D converters P8 by using the clamp pulse (CLP) and the blanking pulse (BLK) from the timing generation unit P1. The analog processing units P6 shift the levels of the amplified analog RGB video signals to the voltage level required in the A/D converters and perform blanking processing for reducing noise in the retrace period.

Low-pass filters P7 are used for the purpose of removing, from the analog video signals from the analog processing units P6, high-frequency signal components which cause aliasing undesired in A/D conversion processing in the A/D converters P8.

The A/D converters P8 covert the analog video signals (T2 in FIG. 2) into digital signals with the period of the clock from the timing generation unit P1.

Each of the inverse γ tables P9 is a table for restoring to a non-γ-corrected linear video signal, a γ-corrected video signal sent from a broadcasting station. This processing is required in the PWM drive type of cold cathode display which has a luminance output which is linear with respect to an input video signal unlike an image display device using a cathode ray tube (CRT).

The line memories P10 temporarily store sampling RGB signals (T4 in FIG. 2) obtained by inverse γ conversion after analog-to-digital conversion in the A/D converters P8. At the time of reading from the line memories P10, the RGB memories are successively called up to obtain a serial RGB signal (T5 shown in FIG. 2) having RGB components in the same order as the RGB arrangement of phosphors in the panel.

The serial RGB signal is input to the X drive module P1100 and is shifted in a shift register P1103 from left to right by the shift clock output from the X control P3. After shifting of all data items corresponding to 2160 dots, all the data in the shift register are latched by latches P1102 by the LD signal T7 shown in FIG. 2.

The data latched by the latches P1102 is compared with outputs from internal counters to output PWM signals (T8A in FIG. 2) varying in PWM pulse width according to the level of the data.

On the other hand, the Y drive module P1001 is constituted by a shift register P1002 and an output buffer P1003. The Y drive module P1001 shifts, by the shift register P1002, a first-line row selection signal T9 shown in FIG. 2 for each horizontal period as in a second-line row selection signal T10 shown in FIG. 2.

At this time, currents from all output buffers P1101 of the X drive module P1100 flow into each output buffer P1003 via the column wiring lines P2003, the cold cathode elements P2001 and the row wiring lines P2002.

If a current of 1 mA per channel (dot) flows, and if there are 2160 channels, the current flowing into each output buffer P1003 is about 1 mA×2160=2.2 A.

Conventionally, by considering this large current, a discrete power MOSFET or, when using an integrated circuit, an integrated circuit having a large output buffer of a low output on resistance (Ron) is used as the output buffer P1003. That is, the output buffer P1003 has been provided in the form of a hybrid IC or an IC of a large chip area, which is disadvantageous in terms of cost etc.

In contrast, in this embodiment of the present invention, a circuit configuration described below is used to supply the Y drive module P1001 at a low cost without using discrete power MOSFET or a large output buffer of a low output on resistance (Ron).

The circuit configuration characterizing the embodiment of the present invention will be described with reference to FIG. 3.

Figure 3:
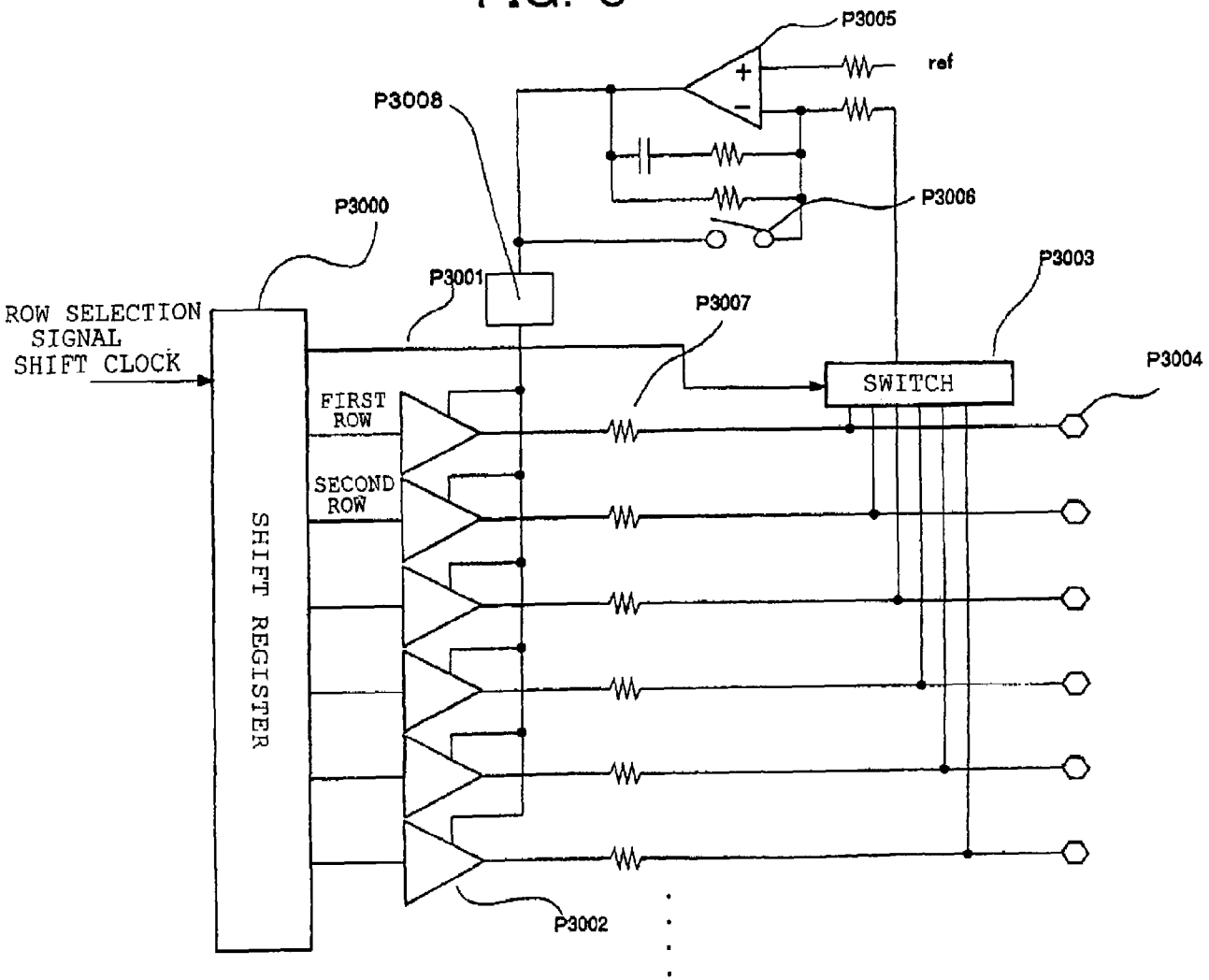
FIG. 3 is a circuit diagram in accordance with a first embodiment of the present invention.

FIG. 3 is a circuit diagram of an example of an IC integrating the Y drive module P1001 shown in FIG. 1. In the circuit configuration shown in FIG. 3, the row selection signal (for selection of one of the Y wiring lines corresponding to 480 rows) is shifted successively from the top position to the bottom position in a shift register P3000 provided as a selecting circuit to drive each of the rows of the elements.

Outputs of the shift register P3000 are connected to output buffers P3002 forming output circuits and supplied through output terminals P3004 of the IC to the matrix wiring outside the IC to perform drive through the matrix wiring.

The on resistances (Ron) of drivers in the output buffers P3002 are indicated by P3007. In actuality, the on resistances exist in the output buffers P3002 forming output circuits. However, for ease of understanding, the on resistances are shown outside the output buffers P3002. Since the output current is large as mentioned above, there is a need to avoid the influence of the voltage drop due to the on resistance. Conventionally, as described above, the on resistance of each output buffer is limited to a small value of several hundred milliohms or less.

In this embodiment, by considering matrix drive in which one row is driven at a time and two or more of the rows are not simultaneously driven, the 480 rows are divided into six modules and one feedback circuit is provided in correspondence with each module to perform feedback control of the output buffers P3002 corresponding to 80 rows.

At the time of output to the first row, a voltage drop is caused in the output buffer P3002 by the on resistance P3007.

For example, in the case of a high-withstand-voltage MOS process, there is a need to form a double diffusion structure and a substantially large chip size is therefore required. If the chip size is limited, the value of the on resistance is about 0.5 to several ohms. If the X drive module P1100 causes a current of, for example, 1 mA per channel, the total current is about 2 A since there are 2160 channels in this embodiment, and the voltage drop of 1 V is caused at the minimum.

A switch P3003 outputs voltage information with respect to the first row on the basis of row information (row selection information) obtained from the shift register P3000 through a parallel signal line P3001. Since the switch P3003 is used for the purpose of obtaining a detected potential, it is not necessary for the switch P3003 to have a reduced resistance value, and there is no problem even if the resistance value of the switch P3003 is several ten kilohms. Therefore the proportion of the area of switch circuit in the total area of the IC is extremely small.

Figure 4:
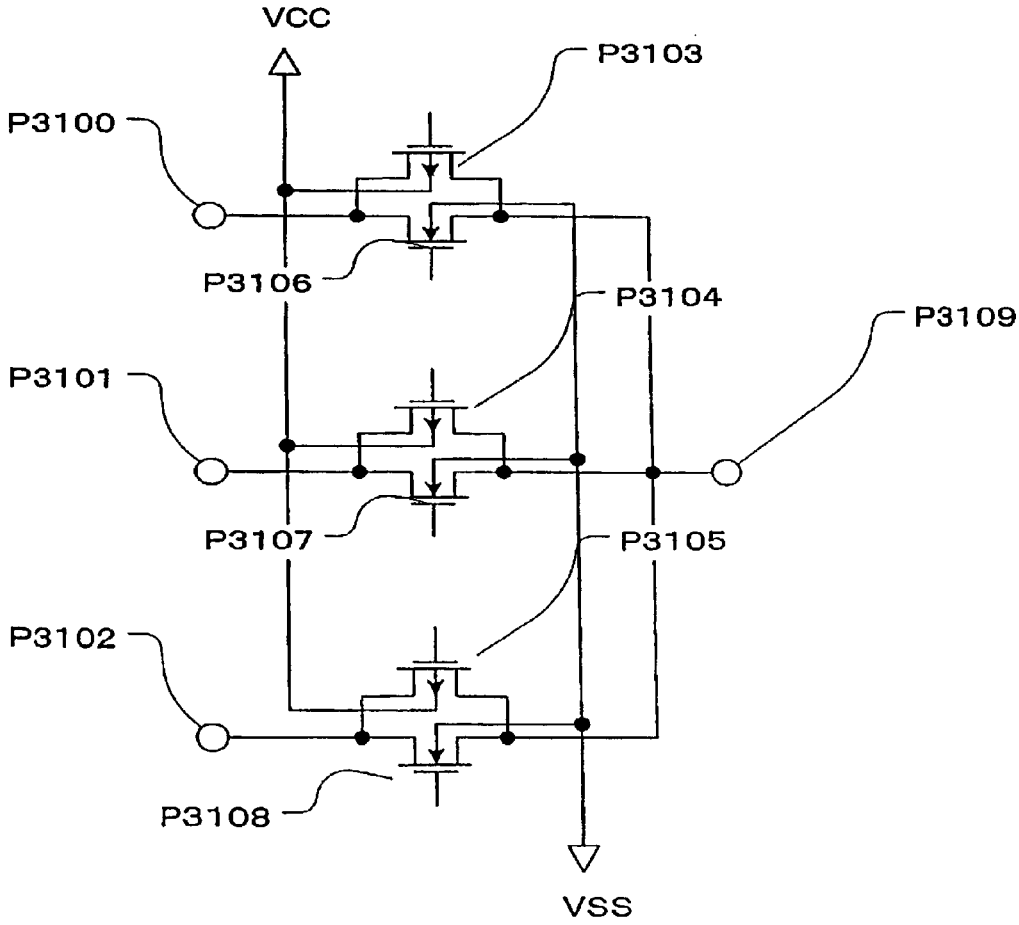
FIG. 4 is a circuit diagram of a switch formed by a CMOS process.
Figure 5:
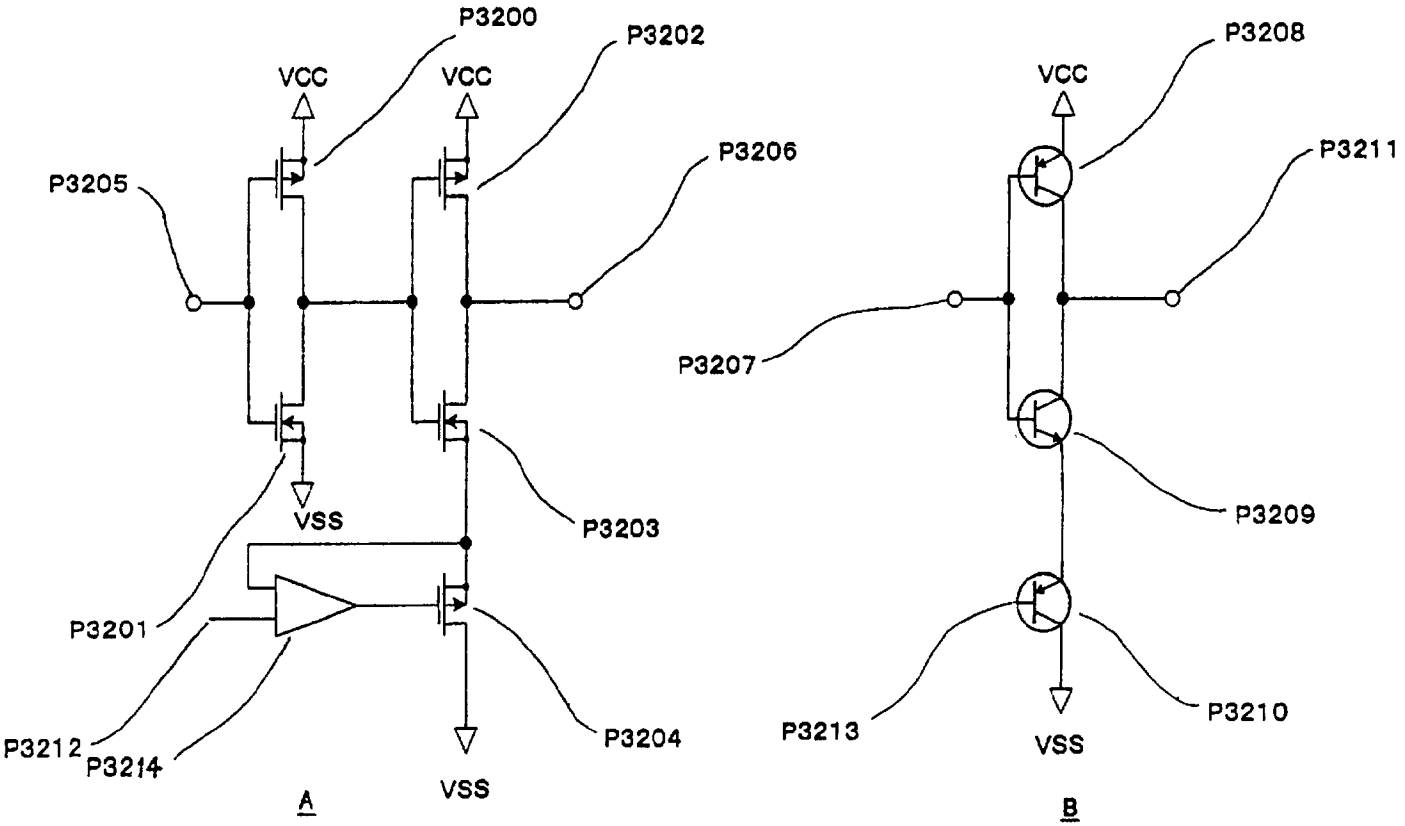
FIG. 5A is a circuit diagram of an output portion formed by a CMOS process.
FIG. 5B is a circuit diagram of an output portion formed by a bipolar process.
Figure 6:
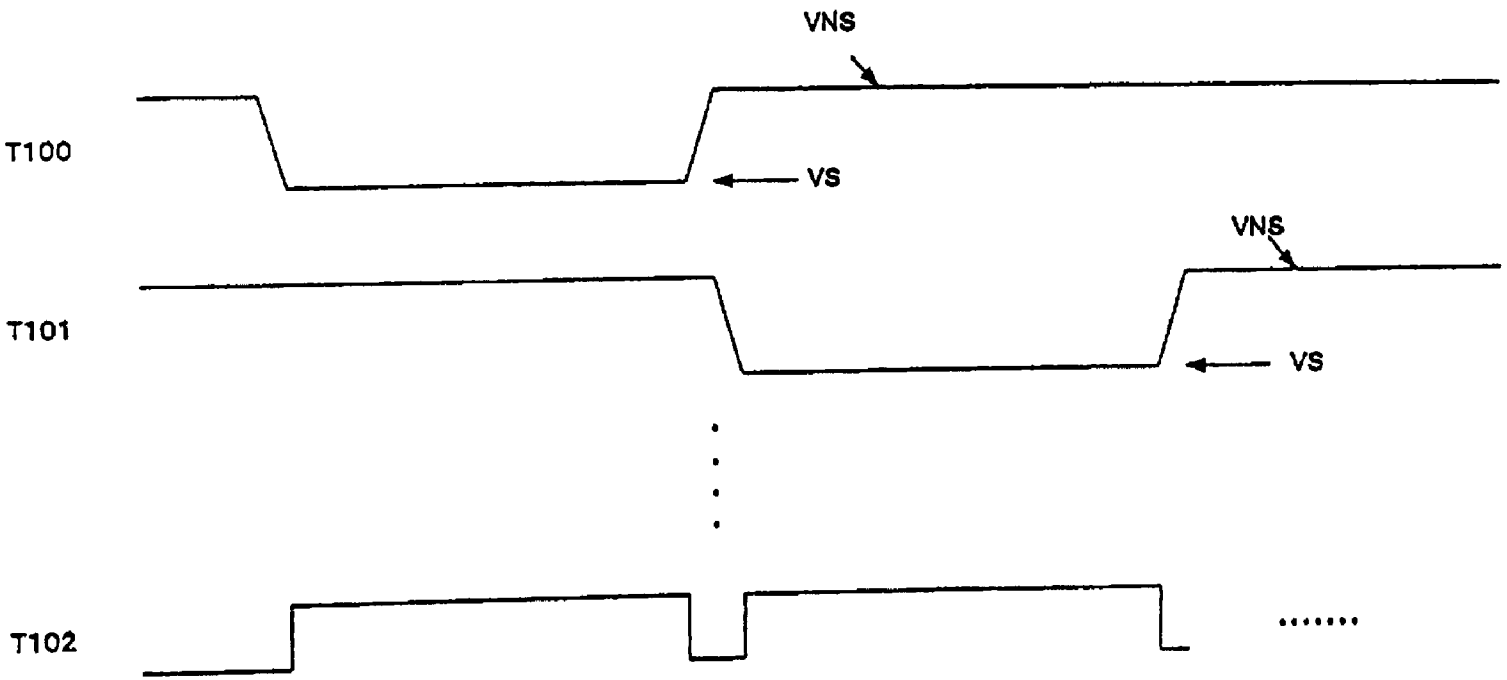
FIG. 6 is a diagram showing the operation of a feedback switch in the semiconductor integrated circuit in accordance with the first embodiment of the present invention.

As the switch P3003, in the case of a CMOS process, an FET switch having a pair structure of an p-channel and an n-channel shown in the switch circuit diagram of FIG. 4 is used.

Pairs of p-channel and n-channel FETs P3103 and P3106, P3104 and P3107, and P3105 and P3108 are respectively connected to input terminals P3100, P3101, and P3102. One of the inputs is selected according to which gates of the FET pairs are turned on to output potential information to an output terminal P3109.

The output from the switch P3003 is amplified by an operational amplifier (OPAMP) P3005 and is supplied as a compensation signal to all the output buffers through an output voltage compensation circuit P3008. The operational amplifier (OPAMP) P3005 and the output voltage compensation circuit P3008 function as compensation signal output means.

However, while only the first row is being driven in matrix, there is no influence on the output drivers for the rows other than the first row. Thus, feedback through the selected first row is performed. That is, the above-described voltage drop can be compensated for by the compensation signal for an increase in voltage such that the apparent voltage drop due to the output current is limited to a small value.

The output buffer P3002 and the output voltage compensation circuit P3008 will next be described with reference to FIGS. 5A and 5B. FIG. 5A is a diagram showing a circuit formed by a CMOS process, and FIG. 5B is a diagram showing a circuit formed by a bipolar process.

In the circuit formed by a CMOS process as shown in FIG. 5A, a drive signal waveform input to an input terminal P3205 is current-amplified by a prebuffer formed by a p-channel FET P3200 and an n-channel FET P3201 since the gate capacity of the output buffer is large.

The current-amplified drive signal waveform is applied to a gate of an output buffer formed by a p-channel FET P3202 and an n-channel FET P3203 to perform driving through an output terminal P3206. At this time, the selecting potential is determined by the gate potential of an FET P3204.

The stability of the gate-source voltage Vgs of the FET is not sufficiently high. Therefore voltage feedback is made thereon by an OPAMP P3214. The compensation signal is applied to an input terminal P3212 of the OPAMP P3214 to achieve output voltage compensation.

In the circuit formed by a bipolar process as shown in FIG. 5B, a drive waveform input to an input terminal P3207 is input to a base of an output buffer formed by a pnp transistor P3208 and an npn transistor P3209. The selecting potential at an output terminal P3211 is determined by the potential at the emitter of the npn transistor 23209, i.e., the base potential of a pnp transistor P3210. Therefore the compensation signal is applied to the base (input terminal P3213) of the pnp transistor P3210, thus enabling output voltage compensation.

In drive of each of the second to 80th rows, correction with respect to the on resistance of the output is also made by operating the switch P3003 and making feedback through the OPAMP P3005 in the same manner.

A switch means P3006 for turning on/off the feedback is provided. Details of the switch P3006 is explained hereafter The switch means P3006 is turned on to stop the feedback operation and to output the reference voltage. The waveform for driving the matrix is a signal having two potentials: selecting potential VS and non-selecting potential VNS, as represented by a signal T100 (first row selection signal) or a signal T101 (second row selection signal) shown in FIG. 6.

When the feedback using the VS as a reference is made, feedback is normally made during the VS period, but a large control error occurs in the VNS period to cause a response delay at the time of subsequent transition to the voltage VS. Therefore the feedback circuit is disabled by a feedback disable signal T102 shown in FIG. 6 to increase the response speed.

Thus, an internal section of an IC is constituted by a switch means, an output buffer of a large resistance value (i.e., of a small chip size) and a feedback circuit to obtain the multiple-output low-resistance drive circuit that has been realized by using a large output buffer in the prior art. By using this arrangement, a low-cost matrix driver can be realized.

The present invention has been described with respect to an example of the configuration of a multiple-output matrix driver using a switch and one compensation signal output means. However, it is also possible to make compensation with respect to the output potential by using compensation signal output means for each output buffer without using the switch P3003, and to thereby realize a low-cost matrix driver. In such a case, it is preferable to use the switch P3006 shown in FIG. 3 in correspondence with each row to cut the feedback of the OPAMP P3005.

(Second Embodiment)

Figure 7:
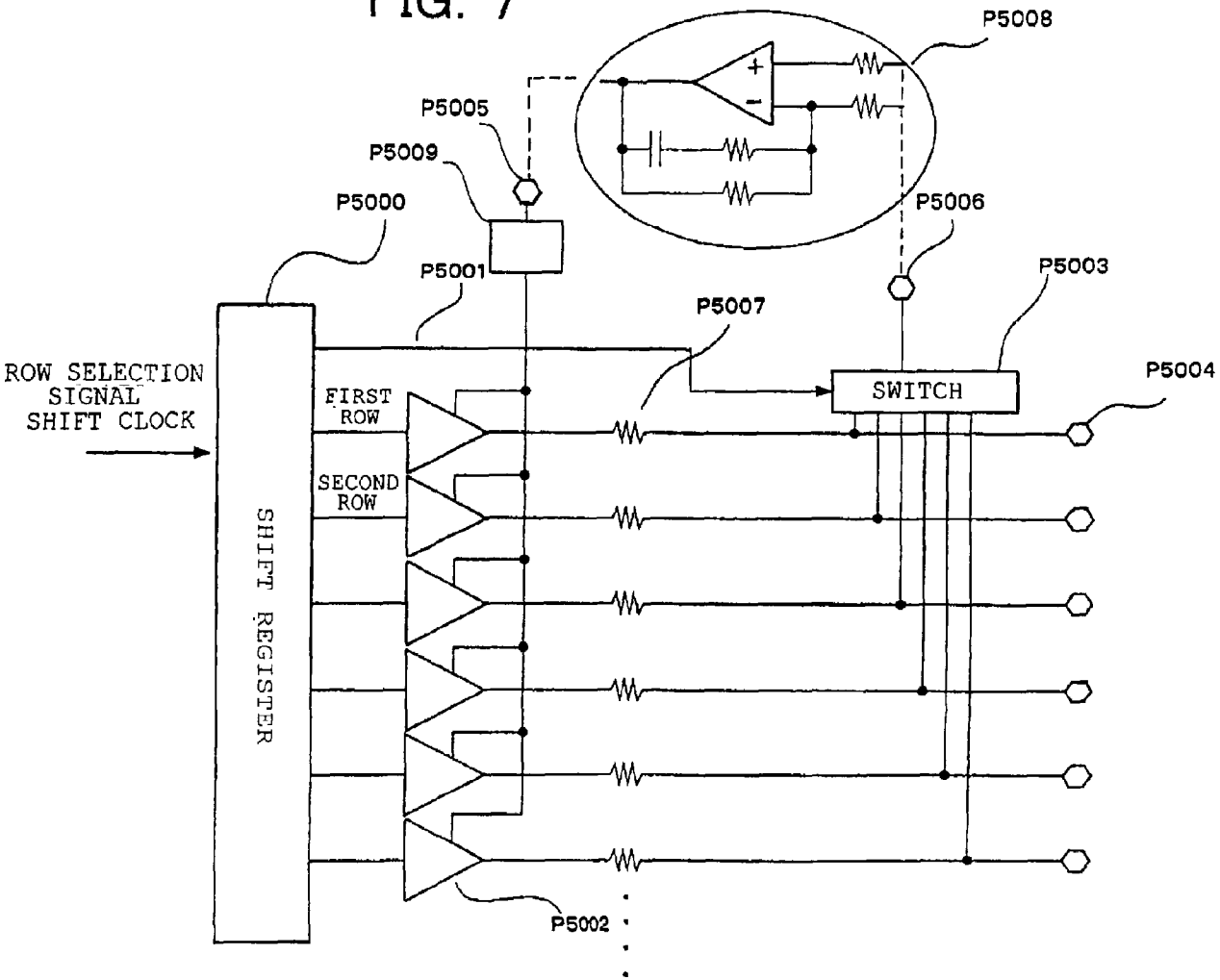
FIG. 7 is a circuit diagram in accordance with a second embodiment of the present invention.

FIG. 7 shows a second embodiment of the present invention. In the arrangement described above as the first embodiment, the compensation signal output circuit is also provided in the semiconductor integrated circuit. This embodiment will be described with respect to an arrangement in which a compensation signal output circuit is provided outside a semiconductor integrated circuit.

With respects to the other points in the configuration and function, this embodiment is the same as the first embodiment. The description of the same components will not be repeated.

More specifically, an example of a circuit which includes a compensation signal output circuit provided outside a semiconductor integrated circuit, and which is used as a driver for a cold cathode display will be described as the second embodiment of the present invention.

The entire cold cathode panel drive circuit is generally the same as that of the first embodiment and the description for it will not be repeated. A description will be made only of a Y matrix drive module with reference to FIG. 7.

FIG. 7 is a circuit diagram of an example of an IC integrating the Y drive module P1001 shown in FIG. 1. In the circuit configuration shown in FIG. 7, the row selection signal is shifted successively from the top position to the bottom position in a shift register P5000 to drive each of the rows of the elements.

Outputs of the shift register P5000 are connected to output buffers P5002 and supplied through output terminals P5004 of the IC to the matrix wiring outside the IC to perform drive through the matrix wiring.

The on resistances (Ron) of drivers in the output buffers P5002 are indicated by P5007. Since the output current is large as mentioned above, there is a need to avoid the influence of the voltage drop due to the on resistance. Conventionally, as described above, the on resistance of each output buffer is limited to a small value of several hundred milliohms or less.

In this embodiment, by considering matrix drive in which one row is driven at a time and two or more of the rows are not simultaneously driven, feedback control using one external feedback circuit is performed on output buffers in the IC corresponding to 80 rows, and drive through the matrix wiring is performed by using output buffers P5002 having a high on resistance (Ron).

At the time of output to the first row, a voltage drop is caused in the output buffer P5002 by the on resistance P5007.

A switch P5003 outputs voltage information with respect to the first row on the basis of row information obtained from the shift register P5000 through a parallel signal line P5001. Since the switch P5003 is used for the purpose of obtaining a detected potential, it is not necessary for the switch P5003 to have a reduced resistance value, and there is no problem even if the resistance value of the switch P5003 is several ten kilohms. Therefore the proportion of the area of switch circuit in the total area of the IC is extremely small.

To enable output from the switch circuit to the outside of the IC, an output terminal P5006 for output from the switch circuit is provided. Also, a compensation signal input terminal of an output voltage compensation circuit P5009 is connected to an input terminal P5005 to enable control from the outside of the IC.

These two terminals are provided to enable connection of the feedback circuit using an OPAMP P5008, etc., outside the IC. It is possible to compensate for the voltage drop due to a resistance P5007, i.e., the on resistance (Ron) of the output buffer P5002, through an output voltage compensation circuit P5009 by using this external feedback circuit.

Similarly, in drive of each of the second to 80th rows, it is possible to perform the compensation for the voltage drop due to the resistance component of the resistance P5007, i.e., the on resistance (Ron) of the output buffer P5002, by the external feedback circuit using the OPAMP, etc. Consequently, the chip area of the output buffer P5002 can be effectively limited.

In the case where the external feedback circuit using the OPAMP, etc., is provided outside the IC, no high-speed analog circuit is required on the IC side and a comparatively simple process for logic circuits or the like can be used. Therefore a further reduction in manufacturing cost can be expected.

On the external feedback circuit side, parameters relating to the performance of the OPAMP, the configuration of the feedback circuit, etc., can be selected. Therefore it is possible to adjust the feedback circuit even after fabrication of the IC.

(Third Embodiment)

Figure 8:
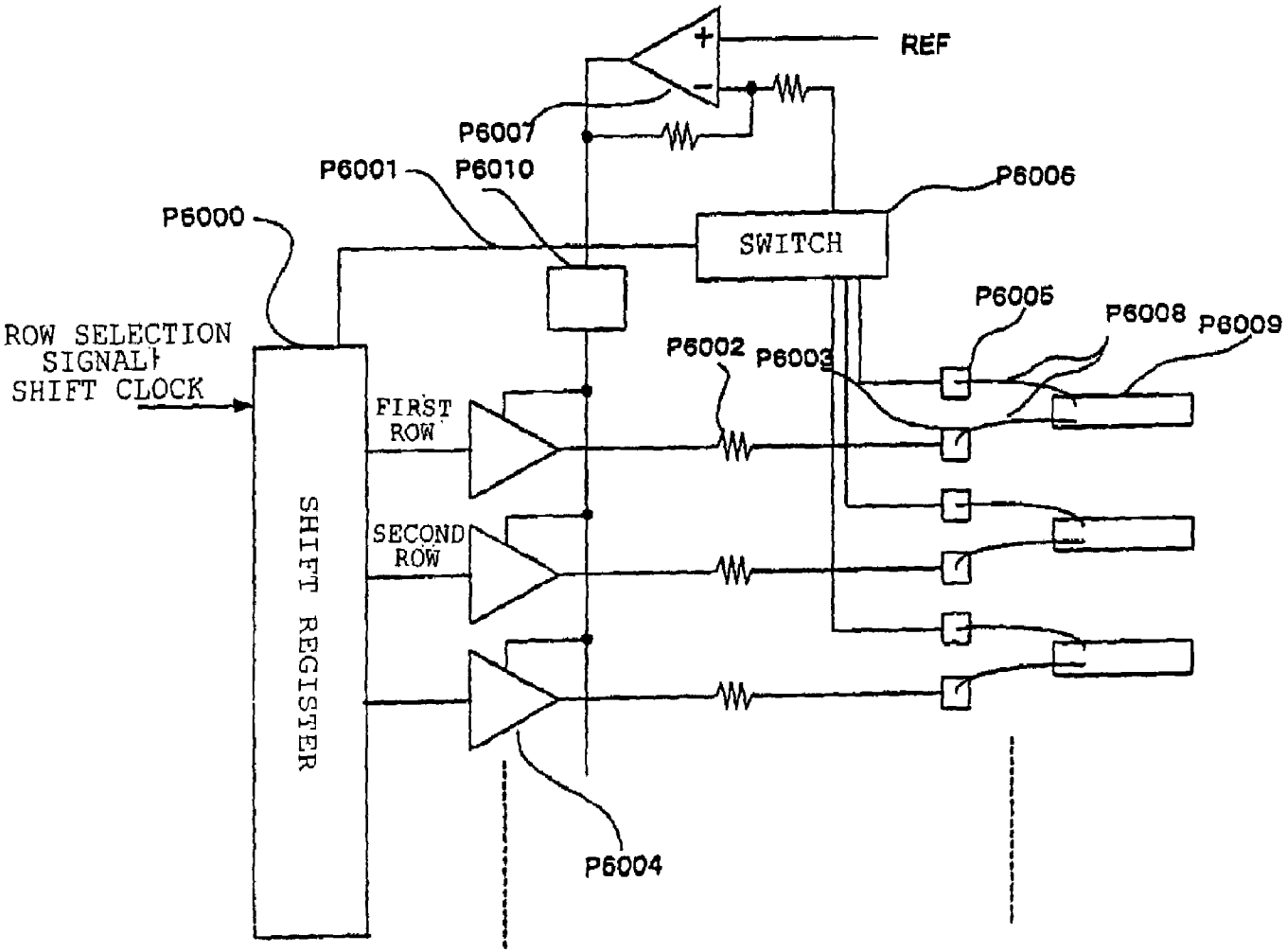
FIG. 8 is a circuit diagram in accordance with a third embodiment of the present invention.

FIG. 8 shows a third embodiment of the present invention. While the first embodiment has been described as an arrangement devised mainly for compensation for the voltage drop due to the on resistance, this embodiment will be described as an arrangement in which compensation with respect to the voltage drop caused by other than the on resistance is also made.

With respects to the other points in the configuration and function, this embodiment is the same as the first embodiment. The description of the same components will not be repeated.

More specifically, in this embodiment, a cold cathode display driver is realized which is capable of output voltage compensation including compensation for voltage drops due to the resistances of bonding wires connecting bonding pads and IC leads.

The entire cold cathode panel drive circuit is generally the same as that of the first embodiment and the description for it will not be repeated. A description will be made only of a Y matrix drive module with reference to FIG. 8.

FIG. 8 is a circuit diagram of an example of an IC integrating the Y drive module P1001 shown in FIG. 1. In the circuit configuration shown in FIG. 8, the row selection signal is shifted successively from the top position to the bottom position in a shift register P5000 to drive each of the rows of the elements.

Outputs of the shift register P6000 are connected to output buffers P6004 and supplied through IC lead P6009 which are output terminals of the IC to the matrix wiring outside the IC to perform drive through the matrix wiring.

The on resistances (Ron) of drivers in the output buffers P6004 are indicated by P6002. Since the output current is large as mentioned above, there is a need to avoid the influence of the voltage drop due to the on resistance. Conventionally, as described above, the on resistance of each output buffer is limited to a small value of several hundred milliohms or less.

In this embodiment, by considering matrix drive in which one row is driven at a time and two or more of the rows are not simultaneously driven, feedback control using one external feedback circuit is performed on output buffers in the IC corresponding to 80 rows.

At the time of output to the first row, a voltage drop is caused in the output buffer P6004 by the on resistance (Ron) P6002.

The output of the output buffer P6004 is connected to a bonding pad P6003 by an aluminum wiring conductor (not shown), and the bonding pad P6003 is connected to the IC lead P6009 by a bonding wire P6008.

Ordinarily, a gold wire having a thickness of about 30 microns is used as the bonding wire P6008.

In this embodiment, to detect the voltage drop at the IC lead P6009, i.e., the sum of voltage drops due to the output buffer, the aluminum conductor (not shown) and the bonding wire P6008, a potential detected from the IC lead P6009 through the bonding wire P6008 is taken into a switch P6006 via a bonding pad P6005 for detection.

Since substantially no current flows through the wiring from the IC lead P6009 to the switch through the bonding wire P6008 and the detection bonding pad P6005, it is not necessary to limit the resistance of the wiring including the resistances of the bonding wire and the aluminum conductor to a small value, and the wire and the conductor small in size on the chip may suffice for this wiring.

The switch P6006 is operated on the basis of row information obtained from the shift register P6000 through a parallel signal line P6001 to select the potential detected from the row currently driven among detected potentials in response to the signal input to the switch P6006.

The detection signal selected by the switch P6006 is amplified by an OPAMP P6007 and input to an output voltage compensation circuit P6010. The output voltage compensation circuit P6010 outputs a compensation signal to the output buffer P6004.

Thus, the bonding pad P6005 and the bonding wire P6008 for potential feedback from the IC lead, the switch means P6006, the feedback circuit P6007, and the output compensation circuit P6010 are provided to enable detection of the voltage drop due to all the resistances: the on resistance (Ron) of the output buffer P6004, the aluminum wiring resistance, and the bonding wire resistance. It is possible to bring the apparent resistance value closer to 0 Ω by compensating this voltage drop. Consequently, the chip area can be reduced and a low-cost semiconductor integrated circuit can be formed.

In matrix panels, a flexible wiring is often used for connection between an IC and column wiring. The influence of a voltage drop due to a resistance in such wiring is not negligible.

Figure 9:
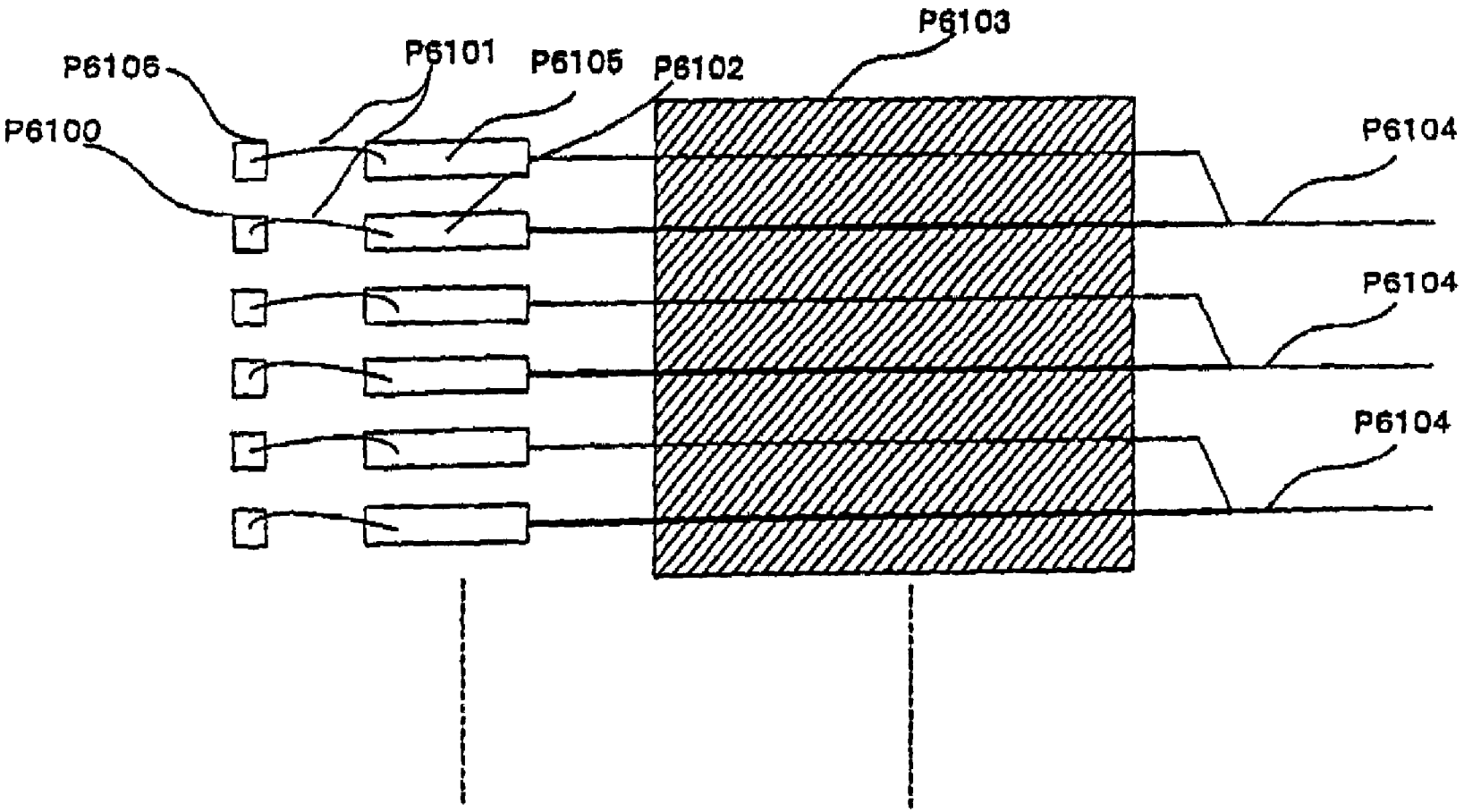
FIG. 9 is a diagram for explaining an arrangement for compensation with respect to the resistance of flexible wiring in accordance with the third embodiment of the present invention.

If connections as shown in FIG. 9 are made outside the bonding pads shown in FIG. 8, compensation can also be made with respect to the resistance of flexible wiring, as described below.

Bonding pads P6100 shown in FIG. 9 are connected to voltage output means. Each bonding pad P6100 is connected to an output IC lead P6102 by a bonding wire P6101.

A bonding pad P6106 for potential detection is also connected by a bonding wire P6101 to an IC lead P6105 for input of potential information outside the IC. The bonding pad P6106 is connected to switch means in the IC chip, as in FIG. 8.

A voltage output from the output IC lead P6102 is connected to the row wiring lines P6104 through the flexible wiring P6103. The resistance of flexile wiring in the prior art has been reduced as much as possible. However, with the realization of display panels higher in resolution, and with the reduction in wiring pitch, a certain degree of influence of the resistance has become unavoidable.

In this embodiment, in contrast, a potential is detected at a point before the row wiring (particularly between the end of the flexible wiring on the row wiring side and the end of the row wiring), wiring for feedback is provided in the flexible wiring, and the potential before the row wiring is taken into the IC chip through the detected potential input IC lead P6105, the bonding wire P6101 and the potential detection bonding pad P6106, thus enabling output potential compensation in the same manner as in the arrangement shown in FIG. 8 and thereby avoiding the influence of the resistance accompanying an improvement in resolution.

(Fourth Embodiment)

Figure 10:
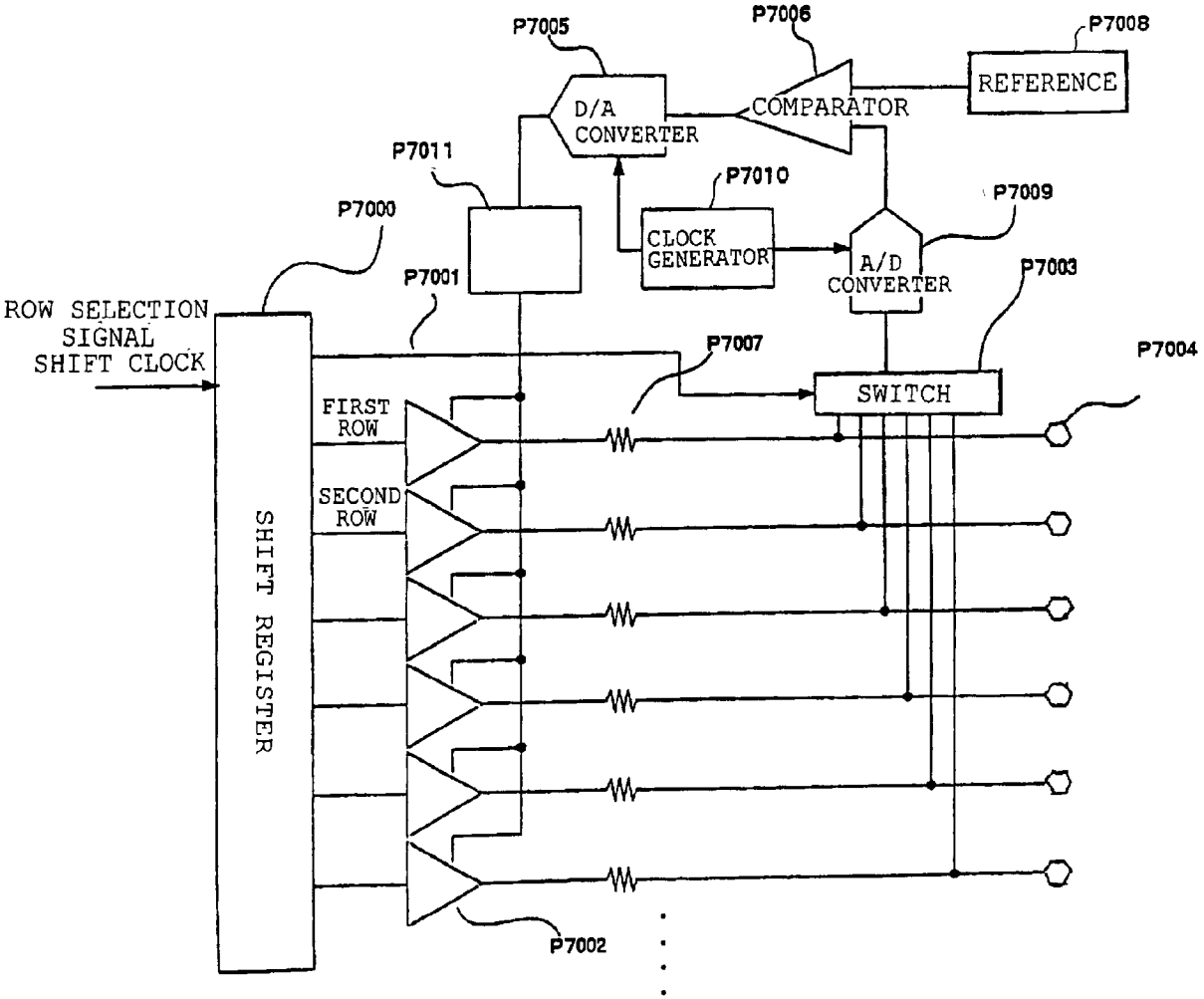
FIG. 10 is a circuit diagram in accordance with a fourth embodiment of the present invention.

FIG. 10 shows a fourth embodiment of the present invention. While the first embodiment has been described with respect to a case where the compensation circuit, etc., are formed exclusively as an analog circuit, this embodiment will be described with respect to a case where a circuit including a digital circuit is formed as a compensation circuit.

With respects to the other points in the configuration and function, this embodiment is the same as the first embodiment. The description of the same components will not be repeated.

More specifically, in this embodiment, a cold cathode display driver is realized by using a semiconductor integrated circuit having output potential compensation means formed as a digital circuit in the IC.

The entire cold cathode panel drive circuit is generally the same as that of the first embodiment and the description for it will not be repeated. A description will be made only of a Y matrix drive module with reference to FIG. 10.

FIG. 10 is a circuit diagram of an example of an IC integrating the Y drive module P1001 shown in FIG. 1. In the circuit configuration shown in FIG. 10, the row selection signal is shifted successively from the top position to the bottom position in a shift register P5000 to drive each of the rows of the elements.

Outputs of the shift register P7000 are connected to output buffers P7002 and supplied through output terminals P7004 of the IC to the matrix wiring outside the IC to perform drive through the matrix wiring.

The on resistances (Ron) of drivers in the output buffers P7002 are indicated by P7007. Since the output current is large as mentioned above, there is a need to avoid the influence of the voltage drop due to the on resistance. Conventionally, as described above, the on resistance of each output buffer is limited to a small value of several hundred milliohms or less.

In this embodiment, by considering matrix drive in which one row is driven at a time and two or more of the rows are not simultaneously driven, feedback control using one external feedback circuit is performed on output buffers in the IC corresponding to 80 rows.

At the time of output to the first row, a voltage drop is caused in the output buffer P7002 by the on resistance (Ron) P7007.

A switch P7003 outputs voltage information with respect to the first row on the basis of row information obtained from the shift register P7000 through a parallel signal line P7001. Since the switch P7003 is used for the purpose of obtaining a detected potential, it is not necessary for the switch P7003 to have a reduced resistance value, and there is no problem even if the resistance value of the switch P7003 is several ten kilohms. Therefore the proportion of the area of switch circuit in the total area of the IC is extremely small.

An output from the switch circuit is converted from an analog signal form into a digital signal form by an A/D converter P7009. A sampling clock for the A/D converter P7009 is generated by an oscillator (not shown) in a clock generator P7010.

Figure 11:
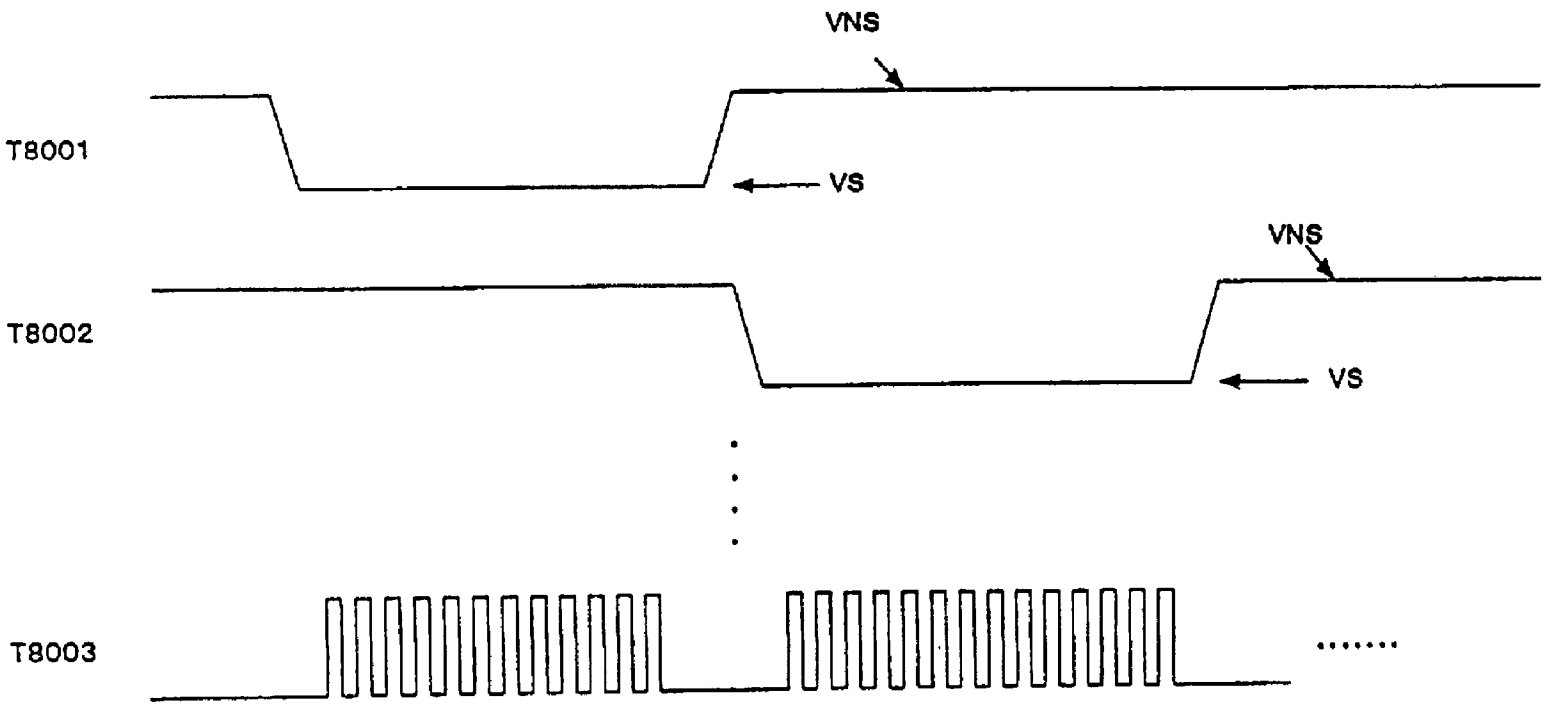
FIG. 11 is a diagram showing a waveform of a sampling clock in accordance with a fourth embodiment of the present invention.

The sampling clock may be synchronized with the horizontal or vertical sync signal in the input video signal by using a PLL. However, this synchronization is not necessarily required. Further, the sampling clock may be output only during a period corresponding to the period of row selection by signal T8001 or T8002 shown in FIG. 11, as shown in a waveform T8003 in FIG. 11.

The output from the A/D converter P7009 is compared by a digital comparator P7006 with reference data P7008, which is a Y output voltage reference. The difference between the Y output voltage and the reference data P7008 is output to a D/A converter P7005. While a hardware comparator is used in this embodiment, a microprocessor may alternatively be used to perform comparison processing.

The D/A converter P7005 converts the output from the comparator P7006 from a digital signal form into an analog signal form and outputs the converted signal with timing of the clock generated by the clock generator P7010.

The output from the D/A converter P7005 is current-amplified by an output voltage correction circuit P7011 formed of a current amplifier circuit constituted by bipolar transistors, etc., and is thereafter used to control the power supply voltage applied to the output buffer P7002. Feedback control is performed by using the feedback loop formed by the A/D converter P7009, the comparator P7006 and the D/A converter P7005 so that the on resistance (Ron) of the output buffer P7002 is apparently minimized.

Thus, the switch means and the feedback circuit using digital components are provided to enable detection of the voltage drop due to the on resistance (Ron) of the output buffer. It is possible to bring the apparent resistance value closer to 0 Ω by correcting this voltage drop. Consequently, the chip area can be reduced and a low-cost semiconductor integrated circuit can be formed.

An example of use as a cold cathode display driver has been described. However, this arrangement is not limited to cold cathode display drivers. It is possible to realize a low-cost drive IC by using this arrangement in any other displays having a matrix configuration.

It is also possible to realize a low-cost drive IC by using this arrangement not only in displays but also in semiconductor integrated circuits in which drive with a low-resistance load is performed.

(Fifth Embodiment)

Figure 12:
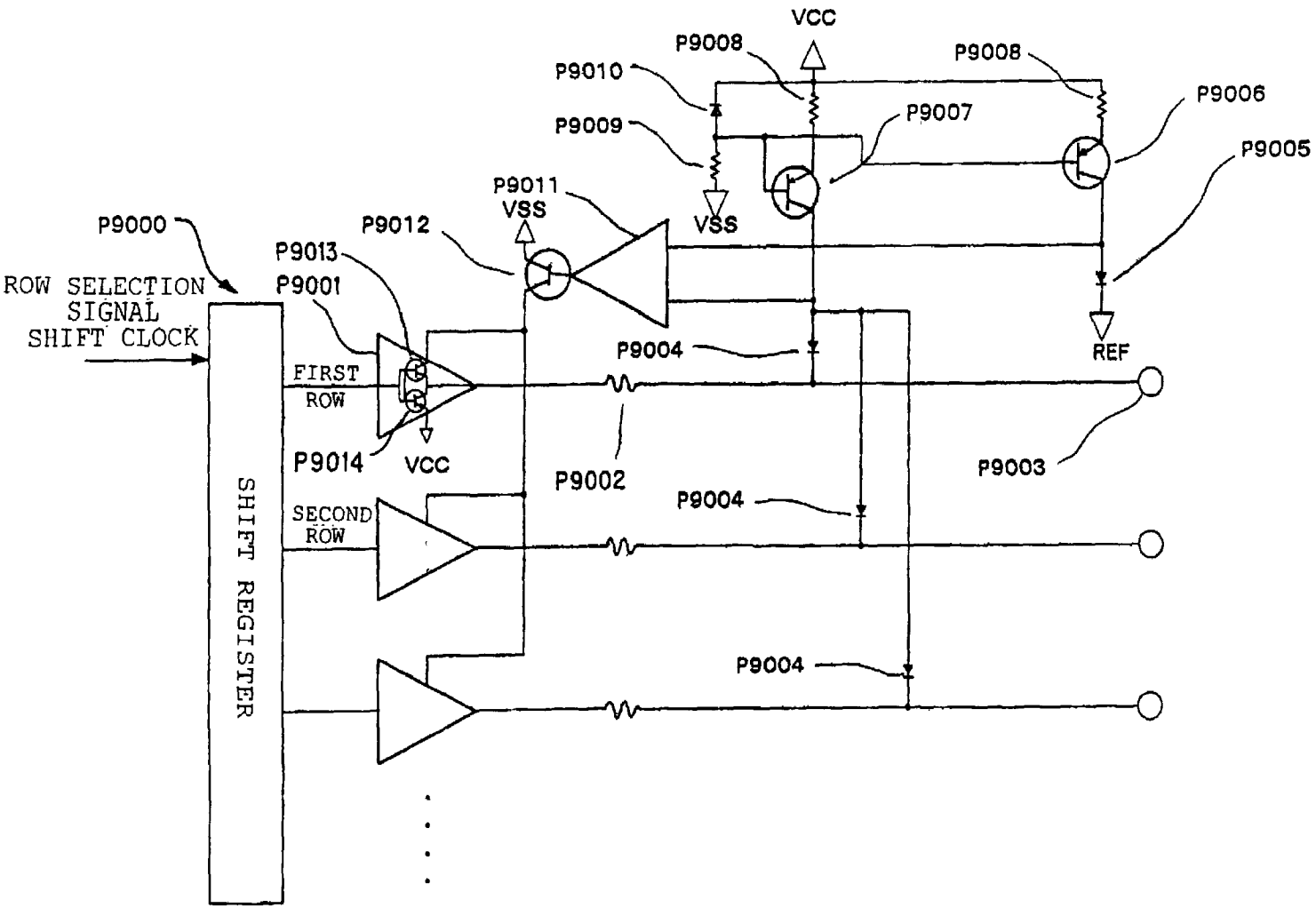
FIG. 12 is a circuit diagram in accordance with a fifth embodiment of the present invention.

FIG. 12 shows a fifth embodiment of the present invention. This embodiment will be described with respect to the configuration of a semiconductor integrated circuit in which a diode is used as a switch, and which is formed by bipolar process.

With respects to the other points in the configuration and function, this embodiment is the same as the first embodiment. The description of the same components will not be repeated.

More specifically, in this embodiment, a semiconductor integrated circuit in which a diode is used as a switch means and which is formed by bipolar process is used to realize a cold cathode display driver.

The entire cold cathode panel drive circuit is generally the same as that of the first embodiment and the description for it will not be repeated. A description will be made only of a Y matrix drive module with reference to FIG. 12.

FIG. 12 is a circuit diagram of an example of an IC integrating the Y drive module P1001 shown in FIG. 1. In the circuit configuration shown in FIG. 12, the row selection signal is shifted successively from the top position to the bottom position in a shift register P9000.

Outputs of the shift register P9000 are connected to output buffers P9001.

The output buffer P9001 is constituted by an npn transistor P9013 and a pnp transistor P9014 in an inverter configuration. Therefore the emitter potential of the pnp transistor P9014 is dominant in the non-selecting voltage (VNS in FIG. 11) of the output buffer P9001, and the emitter potential of the npn transistor P9013 is dominant in the selecting voltage (VS in FIG. 8) of the output buffer P9001.

The output from the output buffer P9001 is supplied via an output terminal P9003 to matrix wiring provided outside the IC to perform driving through the matrix wiring.

The on resistances (Ron) of drivers in the output buffers P9001 are indicated by P9002. Since the output current is large as mentioned above, there is a need to avoid the influence of the voltage drop due to the on resistance. Conventionally, the on resistance of each output buffer is limited to a small value of several hundred milliohms or less.

In this embodiment, by considering matrix drive in which one row is driven at a time and two or more of the rows are not simultaneously driven, feedback control using one external feedback circuit is performed on output buffers in the IC corresponding to 80 rows.

At the time of output to the first row, a voltage drop is caused in the output buffer P9001 by the on resistance (Ron) P9002.

A constant-current supply circuit constituted by a pnp transistor P9007, resistors P9008 and P9009, and a constant-voltage diode P9010 causes a constant current of, for example, 1 mA to flow through one of diodes P9004.

Parallel connections to the rows for supply of the currents from the constant-current supply are established by the diodes P9004. Since as mentioned above matrix drive is performed such that one row is driven at a time and two or more of the rows are not simultaneously driven, the shift register selects only one row at a time and only the selected row has VS potential while the other unselected rows have VNS potential, as described above with reference to FIG. 8. Accordingly, the diodes P9004 corresponding to the unselected rows are reverse-biased to cut off the current.

Therefore the entire current from the constant-current supply flows into the selected row, so that the sum of the potential at the output terminal P9003 and the potential of the forward voltage of the diode is input to the negative input terminal of an OPAMP P9011, the potential being equal to a potential on the anode side of the diode.

The output current from the output buffer P9001 is approximately equal to 2 A, as mentioned above in the description of the first embodiment. Therefore the influence of the 1 mA current from the constant-current supply upon the output buffer P9001 and the matrix panel is not considerably large.

On the other hand, the positive input terminal of the OPAMP P9011 is connected to the anode of a diode P9005 forming a reference potential connection through which a current flows from another constant-current supply constituted by a pnp transistor P9006 and resistors P9008, P9009, and P9010.

In this manner, the influence of the voltage drop according to the forward voltage of diode P9004 on the signal input to the negative terminal of the OPAMP P9011 can be canceled.

When the voltage drop in the output due to the on resistance P9002 of output buffer P9001 occurs, the potential at the output terminal P9003 rises and the potential on the negative side of the OPAMP P9011 also rises.

The output of the OPAMP P9011 pulls the base potential of the pnp-transistor P9012 in the minus direction to perform control of the npn transistor P9013 of the output buffer P9001 such that the influence of the voltage drop in the output due to the on resistance P9002 of the output buffer P9001 is compensated for.

Output voltage compensation is made in the same manner with respect to each of the second and other subsequent rows to minimize the influence of the on resistance P9002 of the output buffer P9001.

Thus, the switch means and the feedback circuit are provided to enable detection of the voltage drop due to the on resistance (Ron) of the output buffer. It is possible to bring the apparent resistance value closer to 0 Ω by correcting this voltage drop. Consequently, the chip area can be reduced and a low-cost semiconductor integrated circuit can be formed.

In the arrangement adopted in each of the above-described embodiments, neither a discrete power MOSFET nor an IC having a large chip area e but an IC having an on resistance of several hundred ohms or higher is used. However, according to the present invention, an arrangement in which a discrete power MOSFET or a component having a large chip area and an on resistance smaller than several hundred ohms is used may be adopted. In such a case, the invention of this application may be applied as an arrangement for outputting scanning signals with higher accuracy.

In the above-mentioned embodiments, the matrix drive in which one row is driven at time is described. However, the present invention is applicable to the matrix drive in which two rows or more are driven at a time. In the matrix drive in which two rows or more is driven at a time, current which flows into each of lines can be made substantially equal each other. It is possible to make compensation (to perform feedback) at a time with respect to two or more lines driven at a time on the basis of the detection of voltage (level of signal) of a part of the lines driven at a time, a line of two lines driven at a time, for example. In such a case, if the lengths of the bonding wires and so on are made substantially equal with respect to adjacent lines driven at a time and currents of each line are also made equal as in the double-lines drive, correction error of each driven line falls within the range of several ten mV in the case of 2 A of drive current.

As described above, the present invention enables compensation for the influence of a voltage drop.

What is claimed is:

1. A scanning circuit which sequentially applies a scanning signal to a plurality of scanning wiring lines of a display device having the plurality of scanning wiring lines and a plurality of modulation wiring lines, said scanning circuit comprising:

a plurality of output circuits each of which outputs the scanning signal to a respective one of the plurality of scanning wiring lines;

a plurality of conductors for respectively forming a path for the scanning signal between each of said output circuits and each of the scanning wiring lines;

a selecting circuit which outputs a selection signal for selecting the scanning wiring lines to which the scanning signal should be applied;

a compensation signal output circuit which outputs a compensation signal to the output circuits according to the signal level at said conductor to which the scanning signal is output for compensating for a loss in the scanning signal in at least one of at least a portion of said output circuit, at least a portion of said conductors, or at least a portion of said output circuit and at least a portion of said conductors; and a plurality of switches connected respectively to the plurality of conductors and connected in common to said compensation signal output circuit, wherein a signal level at said conductor to which the scanning signal is output is supplied to said compensation signal output circuit through the switch corresponding to a said conductor to which the scanning signal is output, and wherein the output circuits which output the scanning signals are compensated on the basis of the compensation signal.

2. A scanning circuit according to claim 1, wherein the signal level is supplied to said compensation signal output circuit through a said switch and an amplifier.

3. An image display device comprising:

a scanning circuit according to claim 1; and a modulation circuit which applies a plurality of modulation signals to the plurality of modulation wiring lines, said plurality of modulation signals corresponding to the plurality of scanning wiring lines to which the scanning signal is applied, the modulation signals being applied while the scanning signal is being applied.

4. An image display device according to claim 3, further comprising display elements driven by the scanning signal applied through the scanning wiring lines, and the modulation signals applied through the modulation wiring lines.

5. A scanning circuit according to claim 1, wherein at least a portion of a circuit constituting said scanning circuit is integrated to form a semiconductor integrated circuit.

6. A scanning circuit according to claim 5, wherein at least a portion of a circuit constituting said scanning circuit and including said output circuit is integrated to form a semiconductor integrated circuit, and the loss in the scanning signal includes a voltage drop due to the on resistance of a driver in said output circuit.

7. A scanning circuit according to claim 1, wherein the output is supplied to said compensation signal output circuit through a said switch and an amplifier.

8. A scanning circuit which sequentially applies a scanning signal to a plurality of scanning wiring lines of a display device having the plurality of scanning wiring lines and a plurality of modulation wiring lines, said scanning circuit comprising:

a plurality of output circuits each of which outputs the scanning signal to a respective one of the plurality of scanning wiring lines;

a selecting circuit which outputs a selection signal for selecting the scanning wiring lines to which the scanning signal should be applied;

a compensation signal output circuit which outputs a compensation signal for compensating for a loss in the scanning signal in; and a plurality of switches connected in common to said compensation signal output circuit, wherein an output from a said output circuit is supplied to said compensation signal output circuit through any of said plurality of switches, and wherein the output circuits which output the scanning signals are compensated on the basis of the compensation signal.

9. An image display device comprises:

a scanning circuit according to claim 8; and a modulation circuit which applies a plurality of modulation signals to the plurality of modulation wiring lines, said plurality of modulation signals corresponding to the plurality of scanning wiring lines to which the scanning signal is applied, the modulation signals being applied while the scanning signal is being applied.

10. A scanning circuit which sequentially applies a scanning signal to a plurality of scanning wiring lines of a display device having the plurality of scanning wiring lines and a plurality of modulation lines, said scanning circuit comprising:

a plurality of transistors each of which outputs the scanning signal to a respective one of the plurality of scanning wiring lines;

a circuit for controlling a potential which is applied in common to the plurality of transistors; and a plurality of switches each of which is connected to the scanning circuit, wherein an output from the transistor outputting the scanning signal among the plurality of transistors is supplied to a compensation signal output circuit through any of the plurality of switches.

11. A scanning circuit according to claim 10, wherein an output from said transistor outputting the scanning signal to said compensation signal output circuit is supplied to said first circuit through said switch and an amplifier.

12. An image display device comprises:

a scanning circuit according to claim 10; and a modulation circuit which applies a plurality of modulation signals to the plurality of modulation wiring lines, said plurality of modulation signals corresponding to the plurality of scanning wiring lines to which the scanning signal is applied, the modulation signals being applied while the scanning signal is being applied.

13. A scanning circuit which sequentially applies a scanning signal to a plurality of scanning wiring lines of a display device having the plurality of scanning wiring lines and a plurality of modulation lines, said scanning circuit comprising:

a plurality of transistors each of which outputs the scanning signal to a respective one of the plurality of scanning wiring lines;

a first circuit connected in common to the plurality of transistors; and a plurality of switches each of which is connected to a respective one of the plurality of transistors, wherein (i) a said transistor outputting the scanning signal among the plurality of transistors, (ii) a said switch connected to said transistor outputting the scanning signal, and (iii) said first circuit constitute a feedback loop for performing a feedback control of the output of said transistor.

14. An image display device comprises:

a scanning circuit according to claim 13; and a modulation circuit which applies a plurality of modulation signals to the plurality of modulation wiring lines, said plurality of modulation signals corresponding to the plurality of scanning wiring lines to which the scanning signal is applied, the modulation signals being applied while the scanning signal is being applied.

15. A scanning circuit according to claim 13, wherein the feedback loop includes an amplifier provided between a said switch and said first circuit.

* * * * *